US006164944A

United States Patent [19]

Martin et al.

[11] Patent Number: 6,164,944

[45] Date of Patent: Dec. 26, 2000

[54] RANDOM ERROR GENERATION OF TOOTH INDEX TO ELIMINATE PUMP NOISE

[75] Inventors: Berthold Martin, Shelby Township; Valentin Botosan, Rochester, both of Mich.

[73] Assignee: DamilerChrysler Corporation, Auburn Hills, Mich.

[21] Appl. No.: 09/282,234

[22] Filed: Mar. 21, 1999

[51] Int. Cl.[7] ..... F04C 2/10; F04C 2/20

[52] U.S. Cl. ..... 418/171; 418/206.5

[58] Field of Search ..... 418/166, 170, 418/171, 206.5

[56] References Cited

U.S. PATENT DOCUMENTS

| | | | |
|---|---|---|---|
| 5,174,334 | 12/1992 | Nogle | 137/596.17 |
| 5,334,112 | 8/1994 | Nogle et al. | 475/59 |
| 5,360,325 | 11/1994 | Henry, IV et al. | 418/170 |
| 5,454,702 | 10/1995 | Weidhass | 418/171 |

FOREIGN PATENT DOCUMENTS

| | | | |
|---|---|---|---|
| 4102162 | 7/1992 | Germany | 418/171 |

OTHER PUBLICATIONS

U.S. application No. 09/283,927, Holbrook, Apr. 1, 1999.
U.S. application No. 09/282,671, Nassar, Mar. 31, 1999.
U.S. application No. 09/283,073, Nogle, Mar. 31, 1999.
U.S. application No. 09/283,912, Redinger, Apr. 1, 1999.
U.S. application No. 09/282,375, Dourra, Mar. 31, 1999.
U.S. application No. 09/281,861, Martin, Mar. 31, 1999.
U.S. application No. 09/282,376, Nogle, Mar. 31, 1999.
U.S. application No. 09/282,675, Martin, Mar. 31, 1999.
U.S. application No. 09/295,713, Nassar, Apr. 21, 1999.
U.S. application No. 09/296,022, Nassar, Apr. 21, 1999.
U.S. application No. 09/251,258, Botosan, Feb. 16, 1999.
U.S. application No. 09/210,977, Correa, Dec. 14, 1998.
U.S. application No. 09/168,836, Dourra, Oct. 8, 1998.
U.S. application No. 09/277,444, Dourra, Mar. 26, 1999.
U.S. application No. 09/273,670, Black, Mar. 23, 1999.
U.S. application No. 09/282,791, Redinger, Mar. 31, 1999.
U.S. application No. 09/282,990, Botosan, Mar. 31, 1999.
U.S. application No. 09/282,669, Botosan, Apr. 1, 1999.
U.S. application No. 09/283,899, Holbrook, Apr. 1, 1999.
U.S. application No. 09/283,910, Holbrook, Apr. 1, 1999.
U.S. application No. 09/283,454, Holbrook, Apr. 1, 1999.
U.S. application No. 09/283,567, Danielson, Mar. 31, 1999.
U.S. application No. 09/283,885, Toussagnon, Apr. 1, 1999.
U.S. application No. 09/295,713, Nassar, Apr. 21, 1999.
U.S. application No. 09/282,383, Collins, Mar. 31, 1999.
U.S. application No. 09/282,991, Martin, Mar. 31, 1999.
U.S. application No. 09/282,676, Martin, Mar. 31, 1999.
U.S. application No. 09/282,988, Martin, Mar. 31, 1999.
U.S. application No. 09/282,368, Collins, Mar. 31, 1999.
U.S. application No. 09/282,987, Nogle, Mar. 31, 1999.
U.S. application No. 09/282,918, Collins, Mar. 31, 1999.
U.S. application No. 09/283,911, Holbrook, Apr. 1, 1999.
U.S. application No. 09/282,670, Redinger, Mar. 31, 1999.

*Primary Examiner*—John J. Vrablik
*Attorney, Agent, or Firm*—Marc Lorelli

[57] ABSTRACT

A pump gear for an automatic transmission oil pump having a plurality of teeth. The thickness of each tooth varies randomly from a baseline thickness $T_B$. Correspondingly, the clearance between each tooth varies randomly between each pair of adjacent teeth. The random variation in tooth thickness prevents the formation of resonant frequencies when the gear pump operates, thereby reducing noise produced by the automatic transmission oil pump.

11 Claims, 3 Drawing Sheets

RANDOM ERROR GENERATION OF TOOTH INDEX TO ELIMINATE PUMP NOISE

BACKGROUND OF THE INVENTION

1. Field of the Invention

The present invention relates generally to an oil pump for an automatic transmission and, more particularly, to a gear pump for a transmission including a pump having teeth formed to a thickness which varies randomly from a baseline thickness.

2. Discussion

A typical automatic transmission utilizes transmission fluid or oil under pressure to lubricate and dissipate heat from the transmission components and to effect engagement and disengagement of planetary gear sets. A gear pump located within the automatic transmission provides the fluid pressure that enables operation of the automatic transmission. Typical gear pumps utilize a drive pump gear which meshes with at least one driven gear. The gear pump receives fluid at an input pressure, and the drive and driven gears cooperate to create fluid pressure at an outlet which is utilized to operate the automatic transmission.

The pump gear of the oil pump typically includes a cylindrical bore which engages the rotor of the torque converter or other input drive element at the input side of the transmission. The cylindrical bore supports a central section or base circle of the pump gear. The central section in turn supports a plurality of gear teeth. Typical pump gears include gear teeth which are formed of uniform thickness and are spaced uniformly apart. It has been determined that such an arrangement causes operation at resonance frequencies which create undesirable audible noise to emanate from the automatic transmission.

Thus, it is an object of the present invention to provide a gear pump for an automatic transmission which generates minimal noise.

It is yet a further object of the present invention to provide a gear pump configured to eliminate operation at a resonant frequencies.

It is yet a further object of the present invention to provide a gear pump for an automatic transmission having a pump gear in which the thickness of the gear teeth varies randomly from a baseline thickness.

SUMMARY OF THE INVENTION

This invention is directed to a fluid pump for a transmission. The pump includes an input port for receiving transmission fluid at an input pressure from the transmission and an output port for providing transmission fluid at an outlet pressure to the transmission. The pump also includes a pump gear for converting fluid at the input pressure to the output pressure. The pump gear includes a plurality of teeth each having a thickness that varies from a baseline thickness, where the thickness of each gear tooth varies randomly from the baseline thickness.

This invention is also directed to a pump gear for a fluid pump. The pump gear includes a central section. The central section supports a plurality of teeth. Each tooth has a thickness that varies from a predetermined baseline thickness. The thickness of each tooth varies randomly from the baseline thickness.

These and other advantages and features of the present invention will become readily apparent from the following detailed description, claims and drawings.

BRIEF DESCRIPTION OF THE DRAWINGS

The drawings, which form an integral part of the specification, are to be read in conjunction therewith, and like reference numerals are employed to designate identical components in the various views.

DETAILED DESCRIPTION OF THE INVENTION

Figure 1:
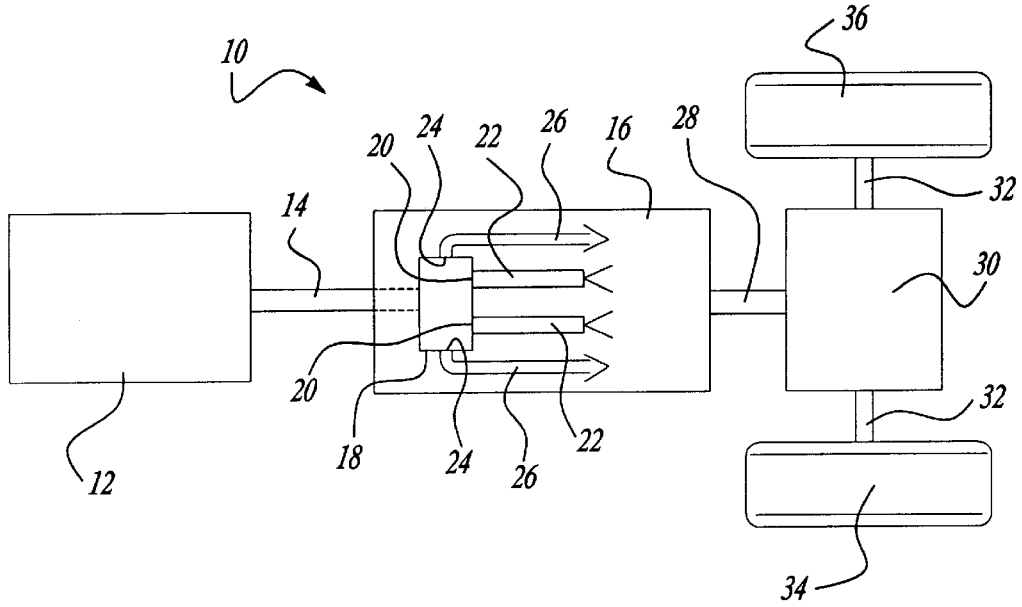
FIG. 1 is a block diagram of a drivetrain system utilizing the automatic transmission gear pump arranged in accordance with the principles of the present invention.

FIG. 1 depicts a block diagram of an exemplary powertrain system utilizing the pump gear arranged in accordance with the principles of the present invention. The powertrain system 10 includes an engine 12. Engine 12 drives input shaft 14 which provides a mechanical input to automatic transmission 16. Automatic transmission 16 includes an oil pump 18 which is configured as a gear pump. Oil or gear pump 18 receives fluid at an inlet pressure at inlet port or ports 20 delivered by input lines 22. Oil or gear pump 18 includes at least one outlet port 24 which provides fluid at an output pressure to output lines 26. Automatic transmission 16 operates as a conventional automatic transmission, many of which are known to those skilled in the art. In particular, automatic transmission drives output shaft 28 which provides mechanical input to differential 30. Differential 30 in turn drives drive shafts 32 which cause rotational movement of the respective wheels 34, 36.

As described above, oil pump 18 is embodied as a gear pump. A particular feature of gear pump 18 will be described with respect to FIGS. 2–4. Gear pump 18 includes a pump gear 40 which is driven by input shaft 14. A generally cylindrical bore 42 engages an output member of the rotor of a torque converter or other driving member to enable rotational movement of pump gear 40. Keyed sections 44 formed in pump gear 40 enable engagement with corresponding keyed sections of the output or driving member.

Figure 4:
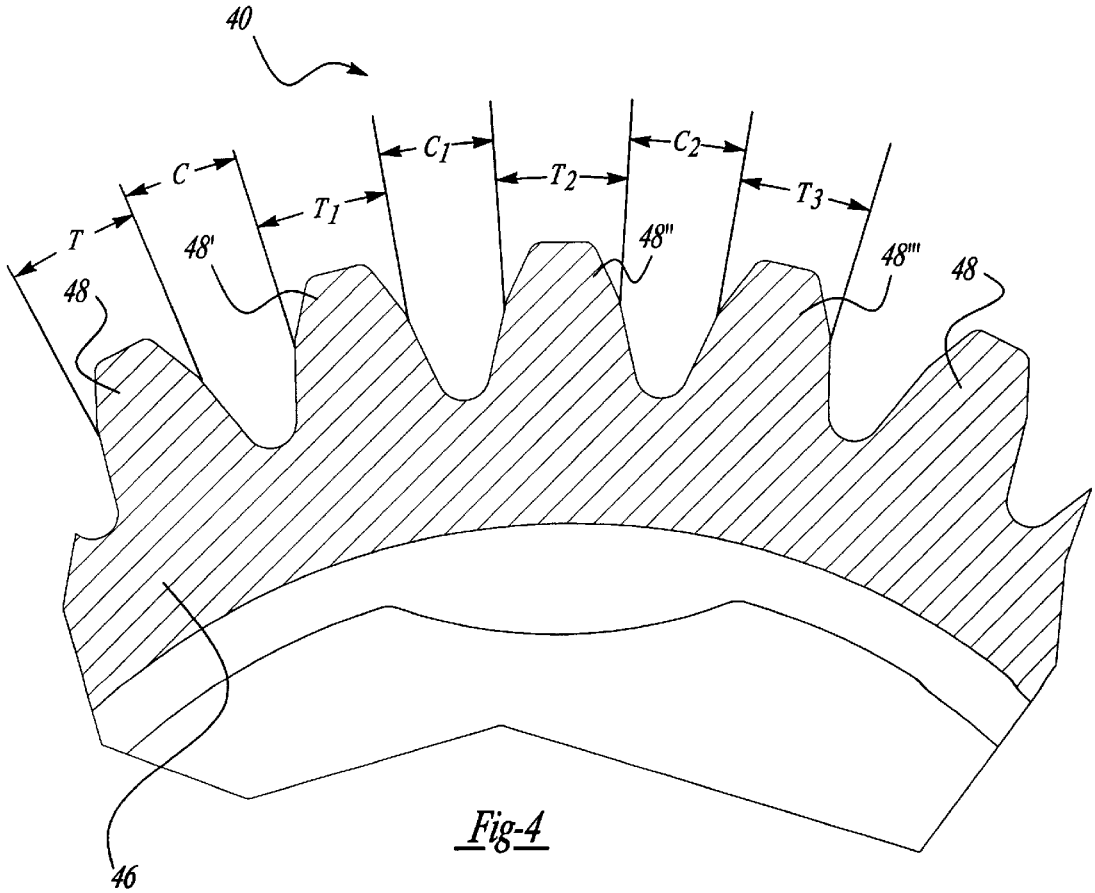
FIG. 4 is a cross-sectional view of the gear teeth of the pump gear of FIGS. 2 and 3.

A central section or body 46 of pump gear 40 supports a plurality of teeth 48. The teeth 48 have a nominal or target thickness T as best seen in FIG. 4. Also, as best seen in FIG. 4, teeth 48', 48", and 48'" are adjacent teeth each having a respective nominal or target thickness $T_1$, $T_2$, and $T_3$. For example, tooth 48' has a thickness $T_1$, tooth 48" has a thickness $T_2$, and tooth 48'" has a thickness $T_3$. The nominal or target thicknesses $T_1$, $T_2$, and $T_3$ vary randomly from a baseline nominal or target thickness $T_B$. Similarly, the distance between each adjacent tooth is defined as clearance C. For example, adjacent teeth 48' and 48" are separated by a clearance $C_1$, and teeth 48' and 48'" are separated by a clearance $C_2$. Because the nominal thickness of each tooth 48 varies randomly from a baseline nominal thickness $T_B$, the tooth thickness T of adjacent teeth varies. Accordingly, the clearance C between two adjacent teeth varies for each pair of adjacent teeth. By arranging gear teeth 48 as described herein, the resulting tooth index pattern for pump gear 40 eliminates pump gear noise by eliminating resonant frequency noise.

Figure 2:
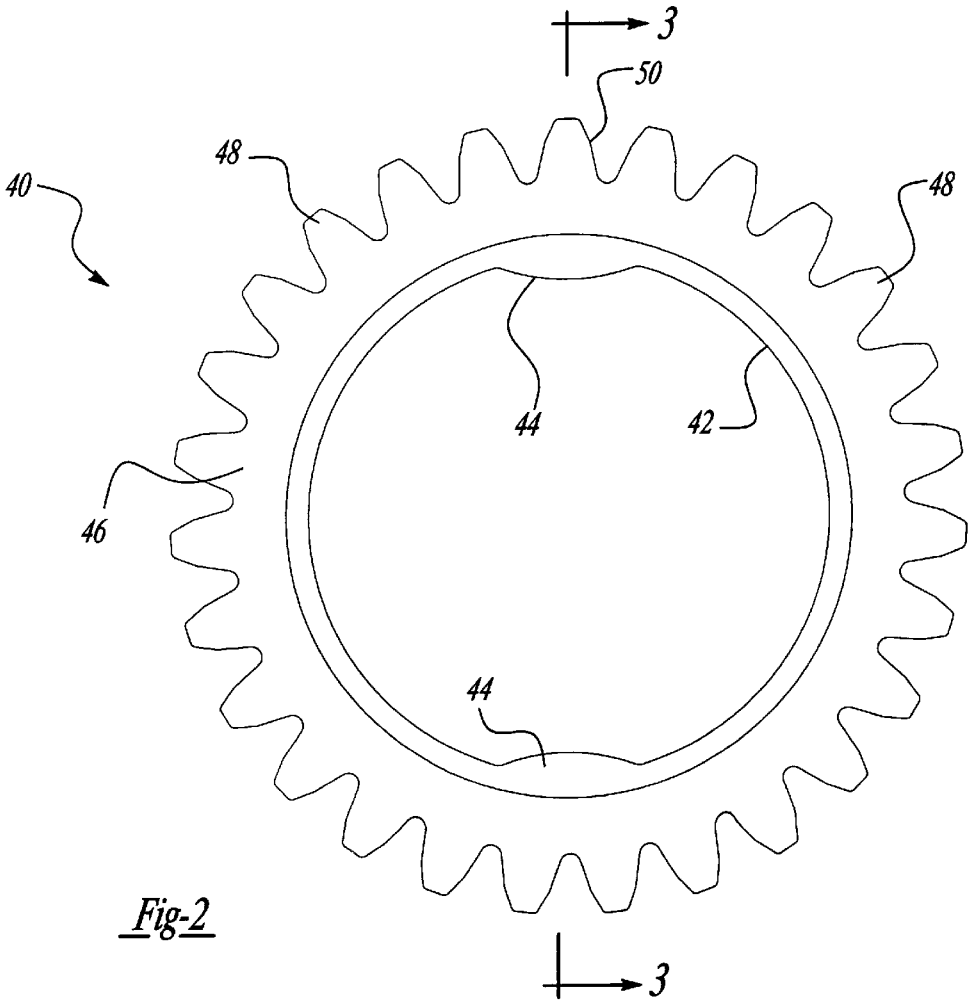
FIG. 2 is an end view of the pump gear of the gear pump of FIG. 1.
Figure 3:
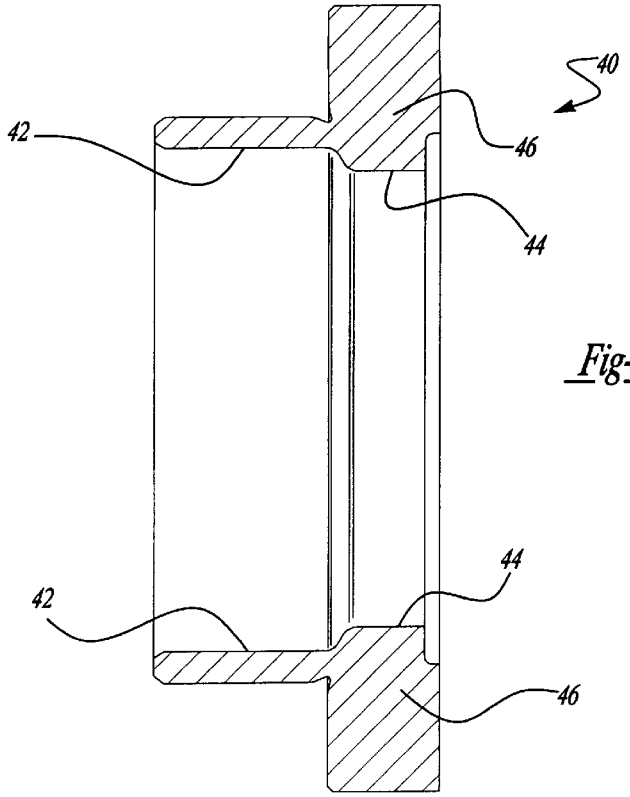
FIG. 3 is a cross-sectional view of the gear pump along the line 3—3 of FIG. 2.
Figure 5:
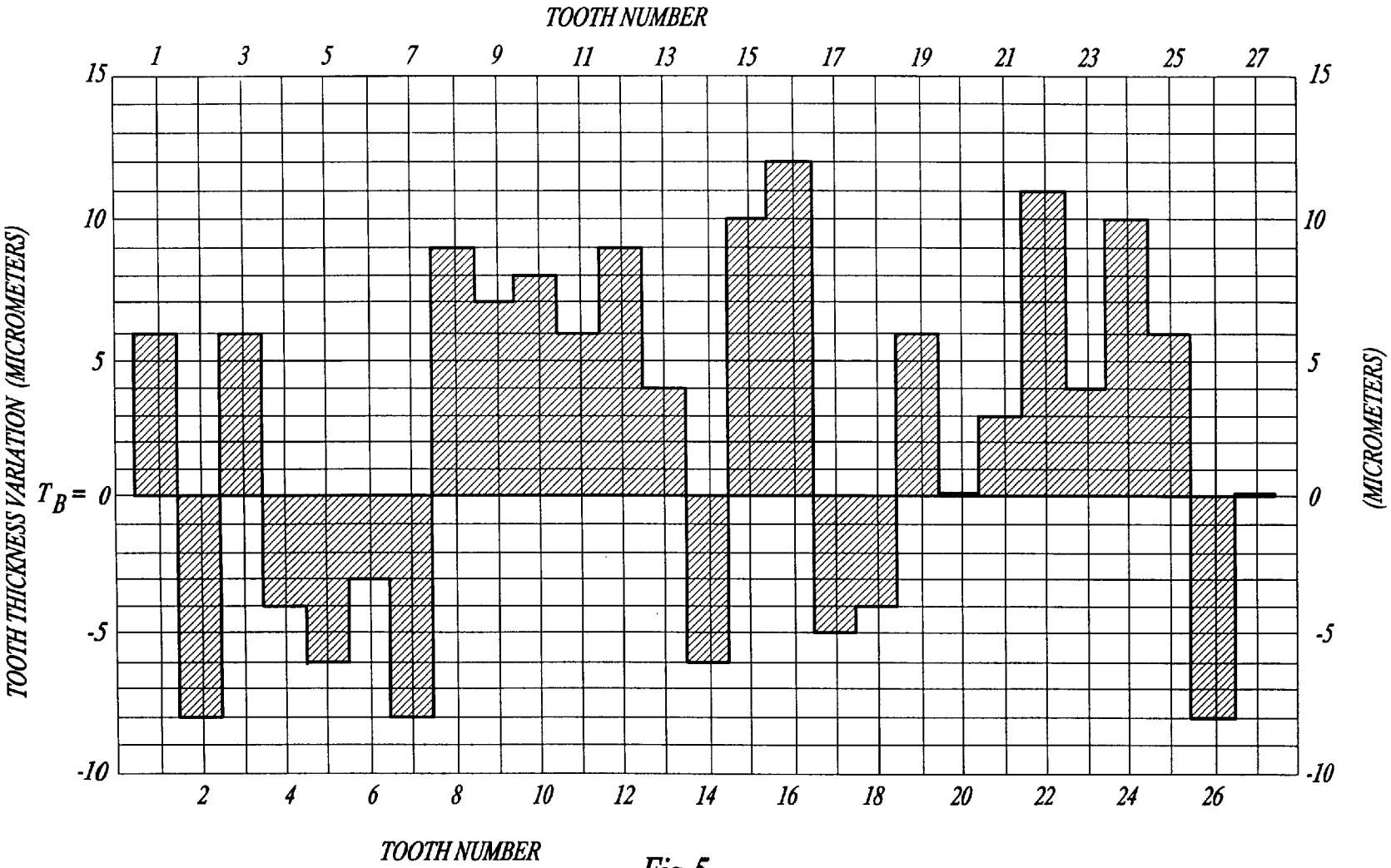
FIG. 5 is a graphical representation of an exemplary random variation of the gear tooth thickness from a baseline thickness.

FIG. 5 depicts an exemplary die intent for defining the random tooth thicknesses for the teeth 48 of pump gear 40 of FIGS. 2–4. Each gradation along the horizontal axis corresponds to a particular tooth of pump gear 40. For example, with reference to FIG. 2, tooth 50 may correspond to tooth 1 of FIG. 5. The teeth 48 may be numbered consecutively moving in either a clockwise or counterclockwise direction from tooth 50. The vertical axis of FIG. 5 represents the tooth thickness variation in micrometers (microns) from a baseline tooth thickness $T_B$.

As shown in FIG. 5, the target baseline thickness $T_B$ corresponds to a random variation of 0 micrometers. The baseline thickness $T_B$=4.041 millimeters (mm) for pump gear 40, by way of example, with a design tolerance of 4.016 mm to 4.066 mm. In FIG. 5, tooth 1, such as tooth 50 of FIG. 1, has a target or nominal thickness 6 microns greater than the baseline thickness $T_B$. Similarly, tooth 2 has a target or nominal thickness which is 8 microns less than the baseline thickness $T_B$. As can be seen from FIG. 5, the target thickness of adjacent teeth varies, thereby varying the clearance between adjacent teeth as well. This nominal or target thickness preferably varies randomly in order to prevent the reduction of resonant frequency noise, but stays within the design tolerance.

While specific embodiments have been shown and described in detail to illustrate the principles of the present invention, it will be understood that the invention may be embodied otherwise without departing from such principles. For example, one skilled in the art will readily recognize from such discussion and from the accompanying drawings and claims that various changes, modifications and variations can be made therein without departing from the spirit and scope of the invention as described in the following claims.

What is claimed:

1. A pump gear for a fluid pump comprising:

a central section; and a plurality of teeth supported by the central section each tooth having a target thickness that varies from a predetermined baseline thickness, wherein the target thickness of each tooth varies randomly from the baseline thickness.

2. The apparatus of claim 1 wherein adjacent teeth have differing target thicknesses.

3. The apparatus of claim 1 wherein the target thickness of each tooth varies within a range of plus or minus 12 micrometers from the baseline thickness.

4. The apparatus of claim 1 further comprising a clearance defined as a distance between adjacent teeth, wherein the clearance varies between adjacent teeth in accordance with the target thickness of adjacent teeth.

5. The apparatus of claim 4 wherein the variation in clearance between adjacent teeth reduces effects from resonant frequencies.

6. In a pump for a transmission comprising:

an input port for receiving transmission fluid at an input pressure from the transmission;

an output port for providing transmission fluid at an outlet pressure to the transmission;

a pump gear for converting fluid at the input pressure to the output pressure, the pump gear including a plurality of teeth each having a target thickness that varies from a baseline thickness, wherein the target thickness of each gear tooth varies randomly from the baseline thickness.

7. The apparatus of claim 6 wherein the pump gear further comprises a central section supporting the teeth.

8. The apparatus of claim 6 wherein adjacent teeth have differing target thicknesses.

9. The apparatus of claim 6 wherein the target thickness of each tooth varies within a range of plus or minus 12 microns from the baseline thickness.

10. The apparatus of claim 6 further comprising a clearance defined as a distance between adjacent teeth, wherein the clearance correspondingly varies between adjacent teeth.

11. The apparatus of claim 10 wherein the variation in clearance between adjacent teeth reduces effects from resonant frequencies.

* * * * *